United States Patent [19]

Gramera et al.

[11] Patent Number: 5,048,379

[45] Date of Patent: Sep. 17, 1991

[54] MULTI-FUNCTIONAL DOUBLE-ENDED SOCKET WRENCHES

[76] Inventors: Robert E. Gramera; David B. Wuchert, both of 704 County Rd. 220, Durango, Colo. 81301

[21] Appl. No.: 500,897

[22] Filed: Mar. 29, 1990

Related U.S. Application Data

[63] Continuation-in-part of Ser. No. 368,040, Jun. 16, 1989, abandoned.

[51] Int. Cl.[5] ..... B25B 13/00

[52] U.S. Cl. ..... 81/124.4; 81/121.1; 81/125.1

[58] Field of Search ..... 81/124.4, 121.1, 125.1, 81/177.2, 177.85

[56] References Cited

U.S. PATENT DOCUMENTS

| | | | |
|---|---|---|---|
| 4,699,029 | 10/1987 | Kelly et al. | 81/177.85 |
| 4,750,750 | 6/1988 | Batalorf, Jr. | 81/177.85 |
| 4,817,475 | 4/1989 | Kelly et al. | 81/177.85 |

FOREIGN PATENT DOCUMENTS

| | | | |
|---|---|---|---|
| 0966700 | 10/1950 | France | 81/124.4 |
| 2462971 | 3/1981 | France | 81/124.4 |

*Primary Examiner*—Frederick R. Schmidt

*Assistant Examiner*—Lawrence Cruz

[57] ABSTRACT

Double-ended, hollow core socket wrenches, tooled for either an English or metric size nut and bolt engaging means in one socket cavity and tooled for either the closest English or closest metric equivalent size nut and bolt engaging means in the opposite socket cavity, are designed to engage and turn hexagonal nuts on protruding bolt studs. The first type of double-ended socket has an axially central external hexagonal surface drive engaging portion, raised from its' substantially cylindrical shell portion, so that it can can be driven externally with a single-ended socket wrench drive member, while the second type of double-ended socket, designed with the same outer drive mechanism described for the first type, has in addition, an internal axially central square drive well engaging portion, accessible from either open socket end, by a conventional extension drive rod member. Whereas, the first type of double-ended socket is designed to engage smaller sizes of nuts and bolts, the second type of double-ended socket is designed to engage larger sizes of nuts and bolts. A combination of both types of double-ended socket wrenches, provides a complete set of hand tools that will engage a full range of small and large English and metric size fittings of regular depth hexagonal nuts and bolts and deep well hexagonal nuts on protruding bolt studs.

10 Claims, 2 Drawing Sheets

MULTI-FUNCTIONAL DOUBLE-ENDED SOCKET WRENCHES

This application is a continuation of application Ser. No. 07/368,040, filed Jun. 16, 1989, which is now abandoned.

FIELD OF INVENTION

The present invention describes hand tools, specifically multi-functional, double-ended, hollow core socket wrenches, that are tooled for either an English or metric size nut and bolt engaging means in one socket cavity and tooled for either the closest English or closest metric equivalent size nut and bolt engaging means in the opposite socket cavity, designed to engage and turn hexagonal nuts on protruding bolt studs.

BACKGROUND OF INVENTION

Some commercial examples of combination hand tools, specifically designed with opposite ends for engaging different size fittings of English or metric nuts and bolts include: open-end and box-end wrenches; flex-box wrenches, standard and offset ratcheting box-end wrenches and open-end/socket-end wrenches, to name a few. Except for the conventional hand driven single-ended socket wrenches, each of the tools described is available in several combinations of sizes to engage more than one size fitting of nut or bolt, whereas a conventional hand driven English or metric socket is tooled to fit only one specific size nut or bolt. This necessitates auto mechanics, machinists, electricians and consumers to purchase a large number of individual single-ended regular depth and deep well sockets to make up a reasonably complete tool set that will accommodate several different jobs. Since foreign imports, such as automobiles, machinery and electronic equipment are assembled with metric fittings and many American made products incorporate English and metric nuts and bolts, separate metric socket wrenches must be purchased, which further increases consumer costs.

Added to this dilemma are the following familiar frustrations and shortcomings experienced by tradesmen and consumers who own large tool sets containing several sockets:(1) An increase in the loss of individual smaller sockets from a set, (2) English and metric sockets often get mixed together in a tool box, causing (3) A significant loss of time on the job, which results in a loss of money when trying to locate the correct size socket for a specific fitting and (4) The added weight of a tool box containing a complete set of regular depth and deep well English and metric sockets. All of the aforementioned disadvantages experienced with conventional single-ended sockets are overcome by the present invention.

U.S. Pat. Nos. 1,469,589, 1,478,736 and Canadian patent No. 735,672, show double-ended sockets with an internal axially central square drive well, accessible from either open socket end by a conventional extension rod for driving the tools. However, these patents do not combine English and metric sizes in one tool, nor can the tools described be used to engage and turn hexagonal nuts on protruding bolt studs.

No where in the patents cited or for that matter in any other publication, has it been found or would it be apparent to one skilled in the art, that double-ended sockets are designed to engage and turn hexagonal nuts on protruding bolt studs, or are tooled for an English size fitting in one socket cavity and tooled for the closest metric equivalent size fitting in the opposite socket cavity.

In none of the prior art examined is there any reference to a complete tool set using the features of the present invention, as suggested for the purpose of providing a full range of commercial sizes, nor is the pairing of closely sized English with metric sizes implied for any kind of double-ended socket wrench.

SUMMARY OF THE INVENTION

The present invention seeks to provide double-ended socket wrenches that are designed to overcome the previously discussed shortcomings of the prior art.

The multi-functional double-ended, hollow core socket wrenches, described in this disclosure, are tooled for either an English or metric size nut and bolt engaging means in one socket cavity and tooled for either the closest English or closest metric equivalent size nut and bolt engaging means in the opposite socket cavity, and are designed to engage and turn hexagonal nuts on protruding bolt studs.

The first type of double-ended socket has an axially central external hexagonal surface drive engaging portion, raised from its substantially cylindrical shell portion, so that it can be driven externally with a single-ended socket wrench drive member, while the second type of double-ended socket having a drive mechanism identical to the one described for the first type, has in addition, an internal axially central square drive well engaging portion accessible from either open socket end by a conventional extension drive rod member.

Whereas, the first type of double-ended socket is designed to engage the smaller sizes of nuts and bolts, the second type of double-ended socket is designed to engage the larger sizes of nuts and bolts.

A combination of both types of double-ended socket wrenches, provides a complete set of hand tools that will engage a full range of small and large English and metric size fittings of regular depth hexagonal nuts and bolts and deep well hexagonal nuts on protruding bolt studs.

Since each of the double-ended socket wrenches described in this disclosure exhibit four separate functions, namely, to engage two different sizes of nuts or bolts for regular depth and deep well fittings, the number of tools required for a complete set, as compared to a conventional socket set, is reduced by 75% , which reduces the weight of the tool set by nearly 50%. The end result is a significant reduction in a tool manufacturer's costs for steel, fabrication, inventory, warehousing and shipping.

These and other features of the present invention will become more apparent from the following description, wherein reference is made to the appended drawings and tables, which are intended as illustrative, rather than as limiting the invention to the specific details herein set forth.

DESCRIPTION OF THE PREFERRED EMBODIMENT

To render the present invention readily understandable, references will be made throughout the descriptive specification, to the data furnished in TABLES I, II and III, appended hereto, as it applies to FIGS. 1 through 15.

In this specification, reference is made to the English size expressed in inches, closest to the metric equivalent size, expressed in mm. Also, the terms double-ended socket, double-ended socket wrench and tool are used interchangably throughout this disclosure.

Figures 1, 2:
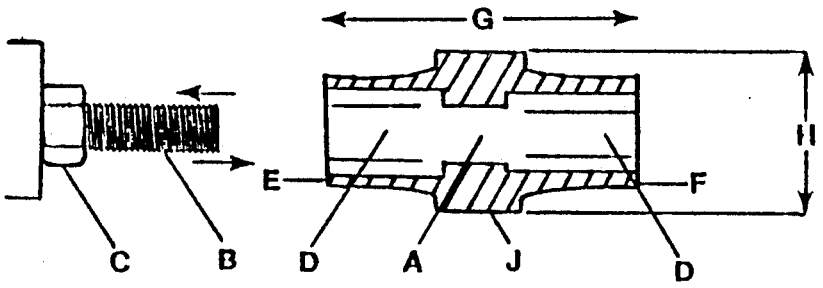
FIG. 1 is a longitudinal cross sectional view of a hollow core, double-ended socket wrench, showing the external drive engaging portion.
FIG. 2 is a side elevation view of a hexagonal nut secured onto a protruding bolt stud.
Figure 3:
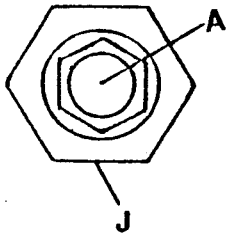
FIG. 3 is an end view of the nut and bolt engaging means looking from the left hand socket cavity side of FIG. 1.
Figure 4:
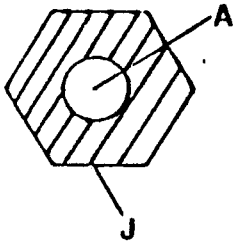
FIG. 4 is a transverse mid-sectional view of FIG. 1, showing the hollow circular core, shown in FIGS. 3 and 5.
Figure 5:
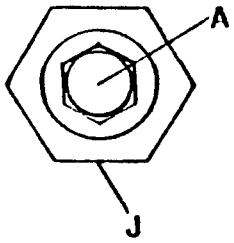
FIG. 5 is an end view of the nut and bolt engaging means looking from the right hand socket cavity side of FIG. 1
Figure 6:
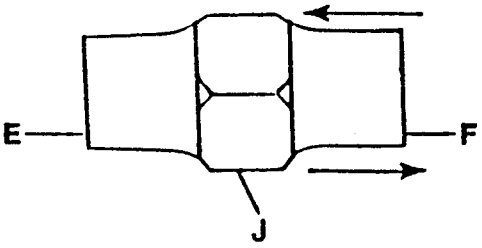
FIG. 6 is a side elevation view of FIG. 1.
Figure 7:
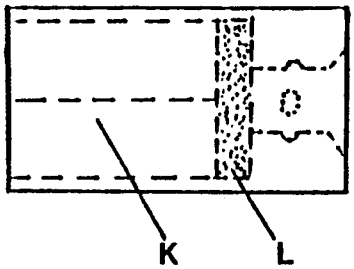
FIG. 7 is a side elevation view of a single-ended socket wrench drive member to drive the tools in FIGS. 1, 6, 8 and 13.

The first type of multi-functional, double-ended socket wrench shown in FIGS. 1 and 6, is designed with an axially central external hexagonal surface drive engaging portion, J, as shown in FIGS. 1, 3, 4, 5 and 6, raised from its cylindrical shell portion, so that the tool can be driven externally, with the single-ended socket wrench drive member shown in FIG. 7.

The open hollow core A, illustrated in FIGS. 1, 3, 4 and 5, is designed with sufficient diameter to accept a protruding bolt stud B, in FIG. 2, when a hexagonal nut, C is fully engaged for turning the nut within socket cavity D, from either the left hand side E or the right hand side F of the tool in FIG. 1.

The combined design features incorporating an open hollow core A and an external hexagonal drive collar J, make it possible for the tool in FIGS. 1 and 6 to be used for both regular depth and deep well fittings, heretofore not possible with any other type of double-ended socket described in the patent literature.

In a practical application, the tool in FIGS. 1 and 6 is specifically designed to engage the smaller English fittings that range in size from ⅛ inch through 9/32 inch and the smaller metric fittings, that range in size from 4 mm through 7 mm, as listed above the dotted horizontal line in TABLES I, II and III.

In TABLE I, for example, six different dual sized double-ended sockets, as shown in FIGS. 1 and 6, would be required to accommodate all fittings listed above the dotted horizontal line. However, only one size socket wrench drive member, as shown in FIG. 7, would be needed to drive all six tools, when the dimensions are kept the same for the end to end length G and distance H between the flats on the hexagonal drive collar J, shown in FIG. 1.

The outer hexagonal drive collar J, for the tool shown in FIG. 6, fits into cavity K of the socket wrench drive member in FIG. 7, and can be engaged from either the right hand end F or the left hand end E. When fully engaged, the tool in FIG. 6 is firmly held within socket cavity K, by a circular magnet L, located in the bottom of socket cavity K, in FIG. 7. Since the socket wrench drive member in FIG. 7, does not obstruct the hollow open core A in FIG. 1, a deep well fitting, as shown in FIG. 2, can be readily engaged as previously described.

The hexagonal drive collar J, in FIGS. 1 and 6 is sized, for example, at 12 mm, to accept a 12 mm size socke wrench drive member in FIG. 7, since the 12 mm fitting is not paired with an appropriate English size to complete the tool set in TABLE I. Drive collar J can also be driven with 12 mm sized open-end, box-end and box-end ratcheting wrenches, which is useful for engaging fittings in confined working areas.

Socket cavities D, for the wrench in FIGS. 1 and 6, may be tooled for either an English size nut and bolt engaging means in socket side E, paired with the closest metric equivalent size nut and bolt engaging means in socket side F; an English size nut and bolt engaging means in socket side E, paired with the closest English size nut and bolt engaging means in socket side F; or a metric size nut and bolt engaging means in socket side E, paired with the closest metric size nut and bolt engaging means in socket side F, as illustrated in TABLES I, II and III, respectively.

Figure 9:
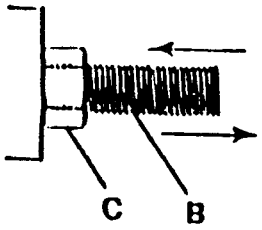
FIG. 9 is a side elevation view shown in FIG. 2.
Figure 8:
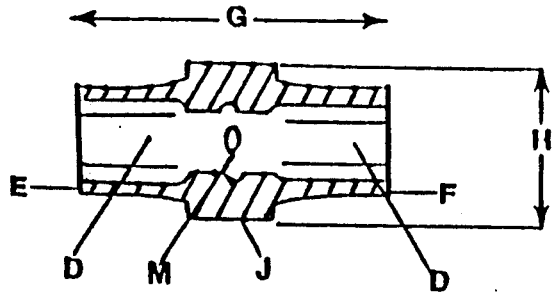
FIG. 8 is a longitudinal cross sectional view of a double-ended socket wrench, showing an external drive engaging portion, combined with an internal central square drive well engaging portion.
Figure 10:
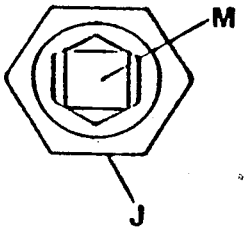
FIG. 10 is an end view of the nut and bolt engaging means looking from the left hand socket cavity side of FIGS. 8 and 13.
Figure 11:
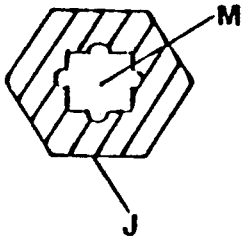
FIG. 11 is a transverse mid-sectional view of the hexagonal external drive engaging member and the internal central square drive well engaging portion shown in FIGS. 8, 10, 12 and 13.
Figure 12:
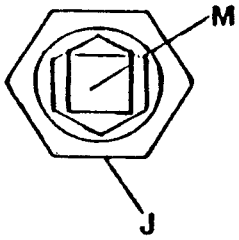
FIG. 12 is an end view of the nut and bolt engaging means looking from the right hand socket cavity side of FIGS. 8 and 13.
Figure 14:
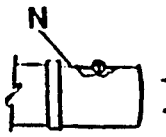
FIG. 14 is a fragmentary side elevation view of the extension drive rod member shown in FIG. 15.
Figure 13:
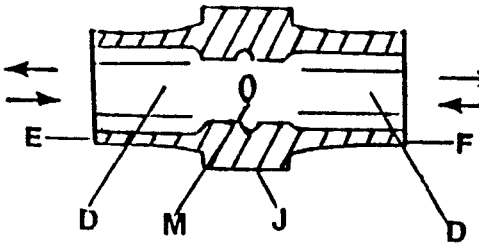
FIG. 13 is a longitudinal cross sectional view shown in FIG. 8.
Figure 15:
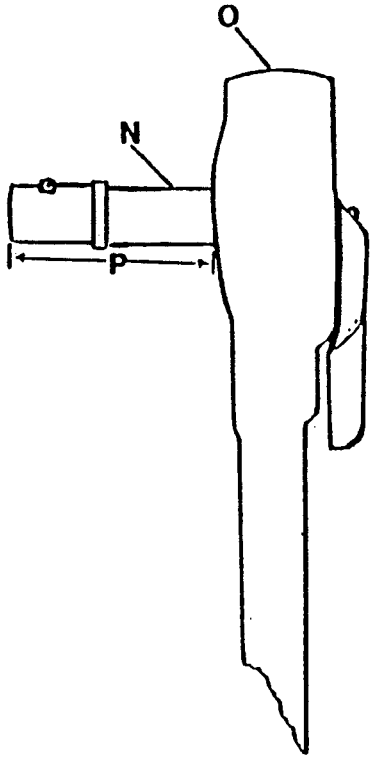
FIG. 15 is a side elevation view of the extension drive rod member shown in FIG. 14, with the opposite square end inserted into a ratchet head and a fragmentary side elevation view of the ratchet handle.

The second type of double-ended socket wrench, shown in FIGS. 8 and 13, designed with the same outer drive mechanism previously described for the first type, shown in FIGS. 1 and 6, has, in addition, an internal axially central, hollow square drive well engaging portion M, accessible from either open socket ends E and F, by a conventional extension drive rod member N, shown in FIGS. 14 and 15. This alternate internal drive is incorporated for engaging regular depth fittings. However, this drive mechanism alone does not provide a means to engage the hexagonal nut C in FIG. 9, since the protruding bolt stud B, would be blocked from entering the internal central square hollow drive well engaging portion shown in FIGS. 8, 10, 11, 12 and 13, when a conventional extension rod N, in FIGS. 14 and 15, is engaged to drive the tool in FIGS. 8 and 13. Since the tool in FIGS. 8 and 13 can be driven externally, with the single-ended socket wrench drive member shown in FIG. 7, a deep well fitting, as shown in FIG. 9, can be engaged.

The combined design features that incorporate an internal drive well engaging portion M, and an external hexagonal drive collar J, make it possible for the tool in FIGS. 8 and 13 to be used for both regular depth and deep well fittings, heretofore not possible with any other type of internal drive, double-ended socket wrench described in the patent literature.

In a practical application, the tool in FIGS. 8 and 13 is designed to accommodate the larger English fittings that range in size from 5/16 inch, through 1 inch and the larger metric fittings that range in size from 8 mm through 25 mm, listed below the dotted horizontal line in TABLES I, II and III.

In TABLE I, for example, four different dual sized double-ended sockets, shown in FIGS. 8 and 13, would be required to accommodate the English size fittings from 5/16 inch through 7/16 inch and the metric size fittings from 8 mm through 11 mm. Only one size socket wrench drive member, shown in FIG. 7, would be needed to drive all four dual sized tools, when the dimensions are kept the same for G and H, shown in FIG. 8. Since open ends E and F, in FIG. 8, has more than a ¼ inch clearance, only one ¼ inch size extension drive rod member N, FIG. 14 and 15, would be needed to internally drive the four tools. A ¼ inch size drive well M, in FIG. 8 is large enough to clear any diameter of protruding bolt stud B, in FIG. 9, that may be encountered, when engaging the four sets of English and metric fittings, previously described.

For the balance of English fittings that range in size from ½ inch through 1 inch and metric fittings, that range in size from 12 mm through 25 mm, listed in TABLES I, II and III, the size of extension rod ends needed to drive the tool in FIGS. 8 and 13, would be dictated by the diameter of the protruding bolt stud B, in FIG. 9, since the opening of the central square drive well M, would have to be large enough to clear a bolt stud B, when different sizes of hexagonal nuts C, in FIG. 9, are engaged. To satisfy the conditions described, three extension rods N, having rod end sizes of ⅜ inch, ½ inch and ¾ inch, would be necessary to drive the tool in FIGS. 8 and 13, for the balance of all larger size fittings shown in TABLES I, II and III. The opposite end of the three extension rods, attached to the ratchet head O, in FIG. 15, could be of one size of, for example, ⅜ inch. Following the rationale used for the first type tool in FIGS. 1 and 6, for dimensions G and H in FIG. 8, three different sizes of socket wrenches, shown in FIG. 7, would be needed to accommodate the deep well fittings for the balance of larger sizes shown in TABLES I, II and III. The modified ratchet O, in FIG. 15, is designed to accept square ended extension rods N, FIG. 14 and 15, of different lengths P, to engage drive well M in FIG. 13. When an extension rod N is fully engaged, the socket ends E and F in FIG. 13 will fit flush to the face of ratchet head O, which reduces the overall length, for operating the tool in confined working areas.

Since the external drive mechanism in FIGS. 8 and 13 is identical to the external drive mechanism in FIGS. 1 and 6, open-end, box-end and box-end ratcheting wrenches can be used to drive the hexagonal collar J, to engage fittings in confined working areas.

Incorporating an external drive mechanism into a double-ended socket, significantly reduces the overall length of the tools in FIGS. 1, 6, 8 and 13, compared to commercial long, deep well sockets, for engaging nuts on protruding bolt studs.

As with the wrench shown in FIGS. 1 and 6, socket cavities D, for the wrench in FIGS. 8 and 13, may be tooled for either an English size nut and bolt engaging means in socket side E, paired with the closest metric equivalent size nut and bolt engaging means in socket side F; an English size nut and bolt engaging means in socket side E, paired with the closest English size nut and bolt engaging means in socket side F; or a metric size nut and bolt engaging means in socket side E, paired with the closest metric size nut and bolt engaging means in socket side F, as illustrated in TABLES I, II and III, respectively.

In TABLE I, there is one exception wherein the 11/16 inch size is paired with an 18 mm size, eventhough the 17 mm size is a closer equivalent to 11/16 inch. This exception occurs since the 17 mm size is already paired with a 21/32 inch size.

Since the smallest practical extension drive rod is ¼ inch the internal drive double-ended socket wrenches in FIG. 8 and 13, cannot be used to engage the smaller sizes of English or metric fittings listed above the dotted horizontal line in TABLES I, II and III, simply because a ¼ inch drive rod will not clear a socket cavity D, in FIG. 1, sized less than 5/16 inch or 8 mm. Hence, a combination of both types of double-ended socket wrenches described in this disclosure, provides a complete set of hand tools for engaging a full range of commercial small and large English and metric sizes of regular depth and deep well fittings. The significant advantage for using both types of tools in a set, is exemplified as follows: With conventional single-ended sockets, a total of 88 tools would be required to engage all sizes of regular and deep well fittings shown in TABLE I, whereas a combination of the tools described in this disclosure would only require a total of 22 tools to accomplish an equal number of jobs. This relates to a 75% reduction in the number of tools required in a set that would weight nearly 50% less. The overall end result is a significant reduction in a tool manufacturer's costs for steel, fabrication, inventory, warehousing and shipping.

While the present invention has been described with specific embodiments thereof, it will be understood that other advantages and objects will become apparent when the foregoing description, including the accompanying drawings and TABLES, are taken in conjuction with the appended claims.

TABLE I

EXTERNAL AND COMBINED EXTERNAL/INTERNAL DRIVE DOUBLE-ENDED SOCKET WRENCHES, SIZED FOR ENGLISH AND METRIC FITTINGS.

| SOCKET CAVITY END E ENGLISH (inch) | SOCKET CAVITY END F METRIC (mm) | |
|---|---|---|
| ⅛ | 4 | ↑ |
| 5/32 | 4.5 | ↑ |
| 3/16 | 5 | EXTERNAL |
| 7/32 | 5.5 | DRIVE |
| ¼ | 6 | (FIG. 1) |
| 9/32 | 7 | ↓ |
| * | | |
| 5/16 | 8 | ↑ |
| 11/32 | 9 | ↑ |
| ⅜ | 10 | ↑ |
| 7/16 | 11 | ↑ |
| ½ | 13 | ↑ |
| 9/16 | 14 | ↑ |
| 19/32 | 15 | EXTERNAL/ |
| ⅝ | 16 | INTERNAL |
| 21/32 | 17 | DRIVE |
| 11/16 | 18 | (FIG. 8) |
| ¾ | 19 | ↓ |
| 25/32 | 20 | ↓ |
| 13/16 | 21 | ↓ |
| ⅞ | 22 | ↓ |
| 15/16 | 24 | ↓ |

TABLE I-continued

| EXTERNAL AND COMBINED EXTERNAL/INTERNAL DRIVE DOUBLE-ENDED SOCKET WRENCHES, SIZED FOR ENGLISH AND METRIC FITTINGS. | | |
|---|---|---|
| SOCKET CAVITY END E ENGLISH (inch) | SOCKET CAVITY END F METRIC (mm) | |
| 1 | 25 | ↓ |

*A 12 mm single-ended socket added to complete the tool set, also serves as a wrench, FIG. 7, to drive the six tools listed above the dotted horizontal line. A 23 mm single-ended socket may be included in the set.

TABLE II

| EXTERNAL AND COMBINED EXTERNAL/INTERNAL DRIVE DOUBLE-ENDED SOCKET WRENCHES, SIZED FOR ENGLISH FITTINGS | | |
|---|---|---|
| SOCKET CAVITY END E ENGLISH (inch) | SOCKET CAVITY END F METRIC (mm) | |
| | | ↑ |
| 1/8 | 5/32 | EXTERNAL |
| 3/16 | 7/32 | DRIVE |
| 1/4 | 9/32 | (FIG. 1) |
| | | ↓ |
| 5/16 | 11/32 | ↑ |
| 3/8 | 7/16 | ↑ |
| 1/2 | 9/16 | ↑ |
| 19/32 | 5/8 | EXTERNAL/ |
| 21/32 | 11/16 | INTERNAL |
| 3/4 | 25/32 | DRIVE |
| 13/16 | 7/8 | (FIG. 8) |
| 15/16 | 1 | ↓ |

TABLE III

| EXTERNAL AND COMBINED EXTERNAL/INTERNAL DRIVE DOUBLE-ENDED SOCKET WRENCHES, SIZED FOR METRIC FITTINGS | | |
|---|---|---|
| SOCKET CAVITY END E METRIC (mm) | SOCKET CAVITY END F METRIC (mm) | |
| | | ↑ |
| 4 | 4.5 | EXTERNAL |
| 5 | 5.5 | DRIVE |
| 6 | 7 | (FIG. 1) |
| | | ↓ |
| 8 | 9 | ↑ |
| 10 | 11 | ↑ |
| 12 | 13 | EXTERNAL/ |
| 14 | 15 | INTERNAL |
| 16 | 17 | DRIVE |
| 18 | 19 | (FIG. 8) |
| 20 | 21 | ↓ |
| 22 | 23 | ↓ |
| 24 | 25 | ↓ |

What is claimed is:

1. A double-ended socket type wrench comprising in combination a hollow shell, substantially cylindrical body portion, nut and bolt engaging means formed internally, adjacent each end of said body portion and extending from each end to a point spaced from the central portion of said body portion, including a passageway extending axially for the entire length of said body portion for receiving a bolt of length equal to or greater than said body portion when engaging a nut with said nut engaging means with said central portion of said body portion, comprising an external hexagonal surface drive engaging portion, raised from said body portion, wherein said nut and bolt engaging means and said central portion are in axial alignment with each other.

2. A double-ended socket type wrench comprising in combination an elongated open ended hollow cylindrical core body portion, nut and bolt engaging means formed internally at each end of said body portion and a drive engaging portion, including a passageway extending axially for the entire length of said body portion for receiving a bolt of length equal to or greater than said body portion when engaging a nut with said nut engaging means comprised of regularly arranged surfaces, raised externally, from mid body portion, intermediate between said nut and bolt engaging means, wherein said nut and bolt engaging means and said drive engaging portion are in axial alignment with each other.

3. The wrench described in claim 1, which includes a single-ended socket drive member, said external drive engaging portion having means to detachably retain said drive member, said drive member engaging said external drive engaging portion by externally enclosing said nut and bolt engaging means at either end of the wrench described in claim 1.

4. The wrench described in claim 2, wherein the diameter of said hollow body portion is of sufficient size to clear a protruding bolt stud when a hexagonal nut on said bolt stud is engaged from either open socket cavity end of the nut and bolt engaging means of said wrench.

5. The wrench described in claim 1, comprising in combination, an internal square drive engaging portion, as part of the hollow core body portion in said central portion of said body portion, wherein said nut and bolt engaging means and said central portion are in axial alignment with each other.

6. The wrench described in claim 2, comprising in combination, an internal square drive engaging portion, as part of the hollow core portion in said central portion of said body portion, wherein said nut and bolt engaging means and said central portion are in axial alignment with each other.

7. The wrench described in claim 5, which includes an extension drive rod member, said internal square drive engaging portion having a means to detachable retain said drive rod member, said drive rod member engaging said internal square drive engaging portion through either end of said nut and bolt engaging means of the wrench described in claim 5.

8. The wrench described in claim 5, wherein the dimensions of said hollow core body portion is of sufficient size to clear a protruding bolt stud when a hexagonal nut on said bolt stud is engaged from either open socket cavity end of the nut and bolt engaging means of said wrench.

9. The wrench described in claim 1, wherein one end of said nut and bolt engaging means is tooled for either, (a) an English size fitting or (b) a metric size fitting and the opposite end of said nut and bolt engaging means is tooled, for the closest, (a) English size fitting or (b) metric equivalent size fitting.

10. The wrench described in claim 5, wherein one end of said nut and bolt engaging means is tooled for either, (a) an English size fitting or (b) a metric size fitting and the opposite end of said nut and bolt engaging means is tooled for the closest, (a) English size fitting or (b) metric equivalent size fitting.

* * * * *